US005972076A

United States Patent [19]

Nichols et al.

[11] Patent Number: 5,972,076

[45] Date of Patent: Oct. 26, 1999

[54] METHOD OF CHARGING AN ELECTROSTATIC PRECIPITATOR

[76] Inventors: Grady B. Nichols, 400 Kiowa St., Montevallo, Ala. 35115; Sabert M Oglesby, Jr., 1348 Panorama Dr., Birmingham, Ala. 35216

[21] Appl. No.: 09/161,477

[22] Filed: Sep. 28, 1998

Related U.S. Application Data

[62] Division of application No. 08/909,271, Aug. 11, 1997.

[51] Int. Cl.[6] ..... B03C 3/66

[52] U.S. Cl. ..... 95/81; 96/82; 323/903

[58] Field of Search ..... 96/80, 82; 95/80, 95/81; 323/903, 240, 242; 204/174; 364/483, 551.01

[56] References Cited

U.S. PATENT DOCUMENTS

| | | | |
|---|---|---|---|
| 3,984,215 | 10/1976 | Zucker | 95/81 |
| 4,209,306 | 6/1980 | Feldman et al. | 95/80 |
| 4,308,494 | 12/1981 | Gelfand et al. | 323/242 |
| 4,311,491 | 1/1982 | Bibbo et al. | 323/903 X |
| 4,390,831 | 6/1983 | Byrd et al. | 323/240 |
| 4,485,428 | 11/1984 | Harris | 96/80 |
| 4,592,763 | 6/1986 | Dietz et al. | 323/903 X |
| 4,648,887 | 3/1987 | Noda et al. | 95/7 |
| 4,670,829 | 6/1987 | Dallhammer et al. | 96/80 X |
| 4,695,358 | 9/1987 | Mizuno et al. | 204/174 |
| 4,808,200 | 2/1989 | Dallhammer et al. | 96/80 X |
| 4,854,948 | 8/1989 | Eiserlo et al. | 323/903 X |
| 4,873,620 | 10/1989 | Neulinger et al. | 363/57 |
| 5,068,811 | 11/1991 | Johnston et al. | 364/551.01 |
| 5,217,504 | 6/1993 | Johansson | 323/903 X |
| 5,477,464 | 12/1995 | Jacobsson | 364/483 |
| 5,575,836 | 11/1996 | Sugiura et al. | 95/81 X |

*Primary Examiner*—Richard L. Chiesa
*Attorney, Agent, or Firm*—Needle & Rosenberg, P.C.

[57] ABSTRACT

A method for charging an electrostatic precipitator, powered by a power supply and having a plurality of corona electrodes and a plurality of collector electrodes, such that a precipitator capacitance may be formed therebetween, includes a storage capacitor across the power supply, having a storage capacitance. A voltage switch is capable of selectively electrically coupling the electrostatic precipitator to the storage capacitor. The storage capacitance is sufficient to charge the electrostatic precipitator to a preselected operative voltage within a rise time greater than a first preselected value and less than a second preselected value.

3 Claims, 3 Drawing Sheets

METHOD OF CHARGING AN ELECTROSTATIC PRECIPITATOR

This application is a divisional of, and claims the benefit of, application Ser. No. 08/909,271, filed Aug. 11, 1997, which status is pending, which application is hereby incorporated herein by reference.

BACKGROUND OF THE INVENTION

1. Field of the Invention

The present invention relates to pollution control systems and, more specifically, to devices for removing pollutants from the effluent of exhaust systems.

2. Description of the Prior Art

Electrostatic precipitators (ESPs) may be used for collecting dust produced by the combustion of coal in generating electricity with commercial electric power boilers. As shown in FIG. 1, ESPs 2 known to the art usually comprise corona electrodes 4, such as long wires, and parallel collection electrodes 6, such as sheet metal plates. In a typical commercial ESP, there are about 50,000 corona electrodes, each about 30 feet long or more, and about 200,000 square feet of collection electrode surface area.

A rectified half-wave or full-wave voltage is applied between the corona electrodes and the collection electrodes. As the voltage reaches a critical value, gasses surrounding the corona electrode break down electrically and produce an avalanche of electrons, thereby forming a "corona" between the electrodes. Moving under the influence of the electric field between the corona and collection electrodes, the velocity of the electrons decrease as they get further from the corona electrodes. This allows electrons to be captured by gas molecules, thereby producing ions which attach to gas-borne particles, such as dust. The particles are then attracted to the collection electrodes by the electric field and the subsequently collected particles are periodically removed from the collection electrodes by rapping the plates.

The power input to an ESP is limited because the ions and the charged particles must pass through the dust layer on the collection electrodes. If the electrical resistivity of the dust is high, the interstitial gasses in the collected dust layer break down electrically when the current is increased above a critical value. This disadvantageous breakdown is referred to as "back corona" and results in positive ions being generated and propelled into the interelectrode space, which may discharge the previously charged particles and cause sparks between the electrodes. Thus, with high resistivity dust, the current is limited so that the collection efficiency is seriously reduced.

Formation of the corona at the corona electrode occurs first at the point along the electrode with the smallest effective radius, producing a local flare as the voltage is increased. The intensity and length of the flare increases until the space charge generated by the ion cloud and charged particles suppress the corona, causing breakdown at the next smallest radius. This process continues until there are a series of discrete flares or corona points along the length of the corona electrode.

Several studies of the distribution of current through the collected dust layer have shown that the highest current density occurs at the point on the dust layer immediately across from a flare and decreases with distance away from the flare. The ratio of peak to average current is approximately two to one. It is peak value of current density that determines the onset of back corona or sparking. Therefore, significant improvement in ESP performance will occur if a more uniform corona is produced, with a peak current density less than a predetermined maximum.

An alternative to rectified sine wave voltage electrification is the application of a pulsed voltage. A number of commercial installations use voltage pulses with a fast voltage rise time and a short pulse duration (typically one microsecond). This results in a much more uniform corona that typically appears as a uniform sheath surrounding the corona wire. With pulsed energization, currents of about twice that of conventional energization can be attained without sparking or the onset of back corona.

The electrical characteristics of a precipitator can be represented by a resistor-capacitor equivalent circuit, with the capacitor parallel to a variable resistor. When a pulsed voltage is applied, the voltage does not fall at the end of the pulse because it is maintained by the charge on the precipitator capacitance. To achieve a pulse, one must dump the charge into a resistor or similar discharge element. Because the amount of energy dumped is large compared to the useful energy, such type of pulsed energization has the disadvantage of not being operationally economical for most applications.

SUMMARY OF THE INVENTION

ESP's of the prior art have the disadvantages of either being power limited due to back corona or having to dump charge to achieve a pulsed voltage. These disadvantages are overcome by the present invention, which in one aspect is an apparatus for charging an electrostatic precipitator powered by a power supply and having a plurality of corona electrodes and a plurality of collector electrodes such that a precipitator capacitance may be formed therebetween. The apparatus includes a storage capacitor, having a storage capacitance, across the power supply. A voltage switch is capable of selectively electrically coupling the electrostatic precipitator to the storage capacitor. The storage capacitance is sufficient to charge the electrostatic precipitator to a preselected operative voltage within a rise time greater than a first preselected value and less than a second preselected value. For example, the first preselected value may be one microsecond and the second preselected value may be ten microseconds.

Another aspect of the invention is a method of modifying an electrostatic precipitator, having a plurality of corona electrodes and a plurality of collector electrodes so that a precipitator capacitance may be formed therebetween. A storage capacitor, having a capacitance sufficient to charge the electrostatic precipitator to a preselected operative voltage within a rise time of less than fifty microseconds, is charged with current from the power supply. The storage capacitor is electrically coupled the power supply so that the storage capacitor is in parallel with the power supply by closing a high-voltage switch placed therebetween. The electrostatic precipitator is electrically isolated from the power supply and the storage capacitor by opening the high-voltage switch, which is capable of periodically connecting the storage capacitor to the electrostatic precipitator and disconnecting the storage in capacitor from the electrostatic precipitator.

Yet another aspect of the invention is a method of charging an electrostatic precipitator, powered by a power supply in parallel with the electrostatic precipitator, having a plurality of corona electrodes and a plurality of collector electrodes such that a precipitator capacitance may be formed therebetween. Charge from the power supply is stored in a capacitive charge storage element having a storage capacitance equal to at least a preselected multiple of the precipitator capacitance. The charge storage element is periodically electrically coupled to the plurality of corona electrodes for a preselected period at a preselected rate. For example, the preselected period may be in the range of from one to ten microseconds and the preselected rate may be 120 cycles per second. Typically, the rate would correspond to that of full-wave or half-wave rectified line voltage.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

A preferred embodiment of the invention is now described in detail. As used in the description herein and throughout the claims, the following terms take the meanings explicitly associated herein, unless the context clearly dictates otherwise: "a," "an," and "the" includes plural reference, "in" includes "in" and "on."

Figure 1:
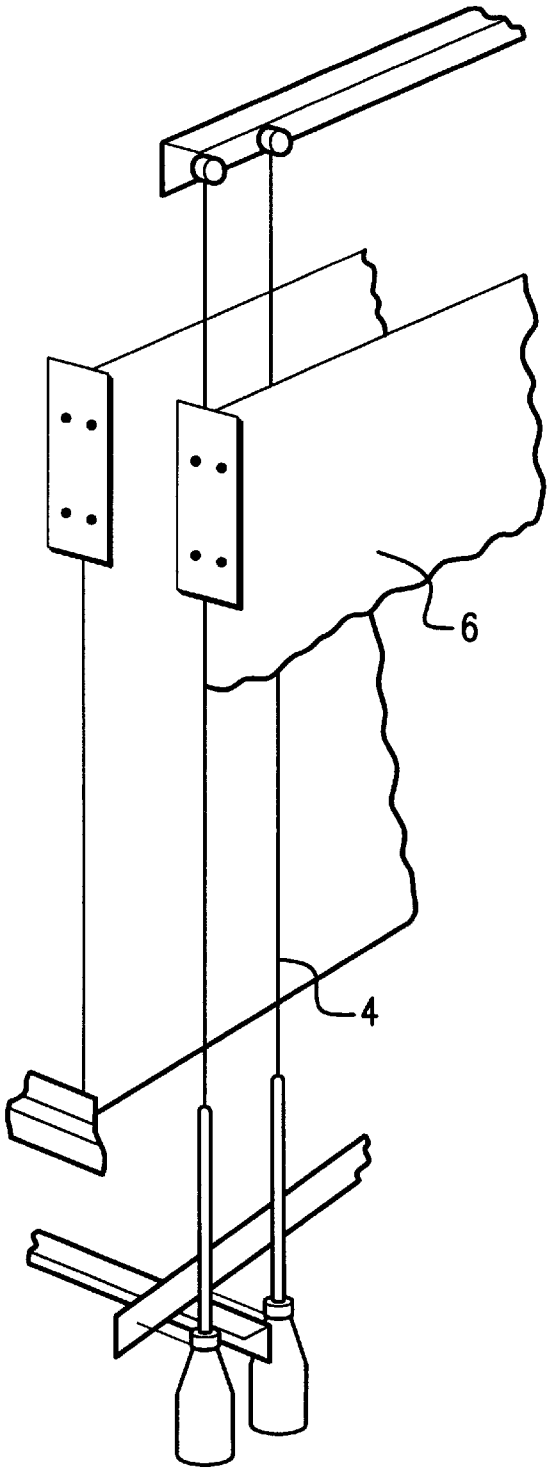
FIG. 1 PRIOR ART
FIG. 1 is a perspective view of a portion of a prior art electrostatic precipitator.
Figure 2:
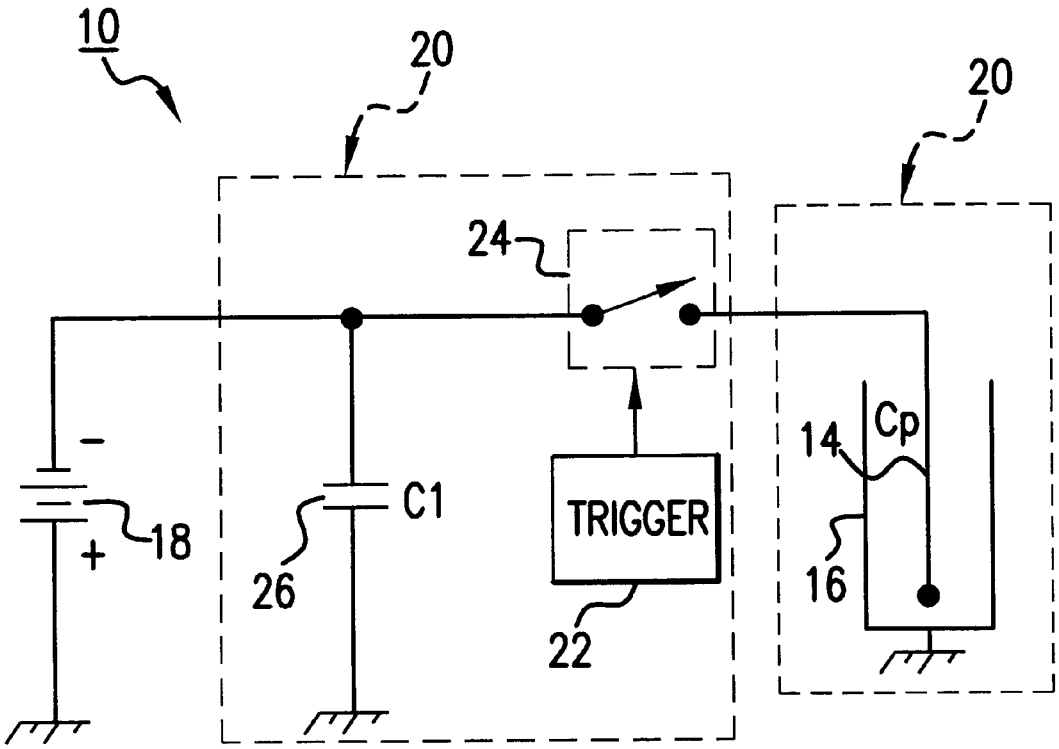
FIG. 2 is a block diagram of an apparatus in accordance with the invention.
Figure 3:
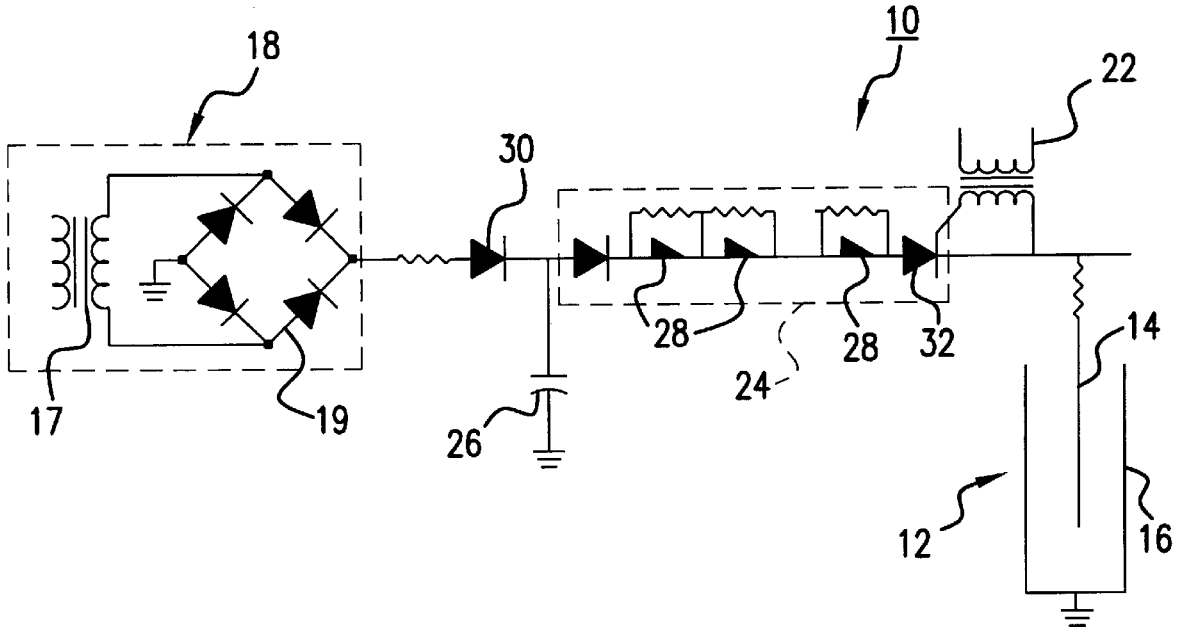
FIG. 3 is a schematic diagram of the apparatus shown in FIG. 2.

As shown in FIGS. 2 and 3, the present invention 10 includes an electrostatic precipitator (ESP) 12, powered by a conventional unfiltered power supply 18, having a plurality of corona electrodes 14 and a plurality of collector electrodes 16. A precipitator capacitance Cp is formed between the electrodes 14 and 16 when a voltage is applied across the ESP 12. A circuit 20 is included, or added to an existing system, to provide periodic voltage pulses to the ESP 12. The circuit 12 includes a storage capacitor 26 across the power supply 18. In one embodiment, the storage capacitor 26 is an oil filled capacitor rated at 80 KV. The storage capacitor 26 has a storage capacitance C1 that is sufficient to charge the ESP 12 to a preselected operative voltage within a rise time greater than a first preselected value and less than a second preselected value. Generally, the storage capacitance C1 should be approximately nine times the capacitance Cp of the ESP 12. For example, in one embodiment the normal capacitance Cp of the ESP 12 is 16 pF and the storage capacitor 26 has a capacitance C1 of 1600 pF.

Although the rise time depends upon the particular configuration of the ESP 12, most conventional ESP's should have a rise time within the range of from one microsecond to ten microseconds. However, with some applications, a rise time of as much as fifty microseconds could be optimal. In other embodiments a rise time of less than one microsecond is conceivable. On the other hand, if the rise time is above 50 microseconds, then the corona will not be uniform and the efficiency of the ESP 12 will be reduced.

A voltage switch 24 is placed between the electrostatic precipitator 12 and the storage capacitor 26. The voltage switch 24 is controlled by a trigger circuit 22 that causes the voltage switch 24 to selectively electrically couple and uncouple the electrostatic precipitator 12 and the storage capacitor 26. In one embodiment, the voltage switch 24 is opened and closed at a rate of about 120 times per second. In such an embodiment, the trigger circuit 22 could simply comprise a full-wave rectified signal from a 60 Hz power line having a low voltage pulse, or any other conventional trigger circuit. The voltage switch 24 could comprise a string of one or more break-over diodes 28 in series with a thyrister 32. However, other types of high-voltage switches (e.g., spark gap, gas-filled thyratron, magnetic switch or solid state) may be employed, depending upon the application. The voltage switch 24 may be cycled non-periodically (e.g., the switch may be closed only one out of four cycles) to control average current density when removing high resistance dust.

As shown in FIG. 3, the power supply 18 comprises an AC voltage source 17 fed into a full-wave rectifier 19. A high voltage diode 30 may be placed in series between the power supply 18 and the storage capacitor 26 to limit current discharge from the storage capacitor 26 into the power supply.

The above described embodiments are given as illustrative examples only. It will be readily appreciated that many deviations may be made from the specific embodiments disclosed in this specification without departing from the invention. Accordingly, the scope of the invention is to be determined by the claims below rather than being limited to the specifically described embodiments above.

What is claimed is:

1. A method of charging an electrostatic precipitator having a plurality of corona electrodes and a plurality of collector electrodes, such that a precipitator capacitance may be formed therebetween, powered by a power supply in parallel with the electrostatic precipitator, comprising the steps of:

a. storing charge from the power supply in a capacitive charge storage element, having a storage capacitance wherein the ratio of the storage capacitance to precipitator capacitance is at least 9:1; and b. periodically electrically coupling the charge storage element to the plurality of corona electrodes for a preselected period at a preselected rate.

2. The method of claim 1, wherein the preselected rate is not greater than 120 times per second.

3. The method of claim 1, wherein the preselected period is between one microsecond and ten microseconds.

* * * * *